US006283672B1

(12) United States Patent
Sovik

(10) Patent No.: US 6,283,672 B1
(45) **Date of Patent: *Sep. 4, 2001**

(54) PAVEMENT EDGER AND JOINT MAKER

(75) Inventor: Robert A. Sovik, Clifton Park, NY (US)

(73) Assignee: Transtech Systems, Inc., Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/411,817

(22) Filed: Oct. 1, 1999

Related U.S. Application Data

(63) Continuation-in-part of application No. 09/356,235, filed on Jul. 16, 1999, now abandoned.

(51) Int. Cl.[7] ..... E01C 19/00; E01C 19/22

(52) U.S. Cl. ..... 404/72; 404/118

(58) Field of Search ..... 404/72, 75, 82, 404/101, 102, 103, 104, 105, 122, 125, 127, 128, 133.05

(56) References Cited

U.S. PATENT DOCUMENTS

| | | |
|---|---|---|
| 2,311,286 | 2/1943 | Tufts . |
| 3,108,518 | 10/1963 | O'Connor, Jr. . |
| 3,398,663 | 8/1968 | Matich . |
| 4,068,969 | 1/1978 | Beach et al. . |
| 4,181,449 | 1/1980 | Lenker . |
| 4,818,140 | 4/1989 | Carlson . |
| 5,051,026 | 9/1991 | Sovik . |
| 5,088,854 | 2/1992 | Sovik . |
| 5,213,442 | 5/1993 | Sovik . |
| 5,336,019 | 8/1994 | Hollon et al. . |
| 5,344,254 | 9/1994 | Sartain . |
| 5,362,176 | 11/1994 | Sovik . |

FOREIGN PATENT DOCUMENTS

| | | |
|---|---|---|
| 990565 | 6/1976 | (CA) . |
| 2 113 358 | 9/1972 | (DE) . |
| 0 027 164 | 4/1981 | (EP) . |

OTHER PUBLICATIONS

Public Works, "Hazards of Pavement Edge Dropoff," Public Works Journal Corporation, Vo. 125, No. 13 p.38, Dec. 1994.

*Primary Examiner*—Robert E. Pezzuto
(74) *Attorney, Agent, or Firm*—Schmeiser, Olsen & Watts

(57) ABSTRACT

A paving machine and edger providing precompaction, horizontal shear compaction and primary compaction of a paving material. The edger includes a plurality of adjustment apparatus for vertical and angular adjustment. A plurality of height indicators are provided for measuring the vertical position of the compaction surfaces of the edger. A wedge extender is removably attached to the edger. The edger is capable of creating a stepped tapered ramp having a highly compacted step and a highly compacted upper portion of the tapered portion.

26 Claims, 15 Drawing Sheets

PAVEMENT EDGER AND JOINT MAKER

The present patent application is a continuation-in-part of U.S. patent application Ser. No. 09/356,235, filed on Jul. 16, 1999, and entitled "Paving Machine and Pavement Edger Therefor," now abandoned.

BACKGROUND OF THE INVENTION

1. Technical Field

The present invention relates generally to paving and, more particularly, to a paving machine and pavement edger therefor.

2. Related Art

Typically, screed pavers include a self-propelled paving machine having a hopper for receiving paving material, e.g., asphalt, from a truck so that the truck progressively dumps its load of paving material into the hopper. A conveyor system on the paving machine transfers paving material from the hopper rearwardly for discharge onto the roadbed in front of transversely arranged screw augers which spread the material laterally in front of a main screed. This main screed functions to compress and level the paving material distributed by the augers to give a smooth finished road surface. The height and attack angle of the main screed may be varied to control the depth and surface of the pavement mat. The main screed may also include screed extenders to allow for a wider pavement mat to be laid.

One of the problems in paving of multiple lanes, especially on high speed interstate highways, is the drop off at an edge of a new pavement mat. During paving operations, it is oftentimes impossible to pave two lanes in a short time span due to a variety of reasons, e.g., traffic, equipment shortages, etc. One reason, in particular, is time constraints caused by the paving crew having to back up and start the second or closure pass on a two lane paving operation at mid-day. Where more than two lanes are being paved, the paving crew must back up at least twice during the day to minimize drop off length on both lanes being paved. Despite the drop off problem, it has become common practice for paving crews to pave only a single lane during one paving day to avoid having to back up. The entire length of this pass therefore becomes a drop off. Where an edge must be left overnight, a drop off of up to 1½ inches has not been considered objectionable for a short distance.

While a drop-off is usually only an overnight or weekend problem, it creates safety problems such as: vehicle wheels becoming caught on the drop off during lane changes onto or from the new mat, and loose stones/aggregate being kicked up by vehicles. In response to these safety problems, federal and some state highway contracting regulations are now mandating that any drop off between a new pavement mat and any adjacent material, e.g., un-repaved asphalt, shall not have a height over one inch unless a paved ramp is provided from/to the new pavement mat. Because it is often highly undesirable to lay a new layer of pavement of an inch or less, in most cases when one lane is laid, it must be provided with a ramp.

Ramps, unfortunately, create a number of other problems. One problem is at the beginning or ending of a mat, the wedge section must be adjusted manually during the transition, thus increasing the potential for an unacceptable section of pavement. Another problem with ramps is that they make it more difficult to create solid joints.

To address the joint creation and drop off problems, the concept of the "tapered joint" ramp was developed. At least two versions of tapered joints are in use: First, as shown in FIG. 1A, the "Jersey Unit," as developed in the state of New Jersey during the 1980's, includes a first pavement mat 6 including a ramp 1 having a tapered portion 2 extending from a surface 3 of an adjacent and/or underlying material 4 directly up to a horizontal surface 5 of the pavement mat 6. Second, as shown in FIG. 1B, the "Stepped Tapered Joint," as currently used in the state of Michigan, includes a first pavement mat 16 including a ramp 11 having a tapered portion 12 extending from a step 12B to a second step 12A on a surface 13 of an adjacent and/or underlying material 14. The stepped tapered joint is basically a stepped jersey unit.

While tapered joint ramps cure the drop off problem, it unfortunately remains extremely difficult to form a solid long-lasting joint for the reasons that follow.

In terms of the jersey unit, a number of problems arise:

First, traffic which crosses over tapered portion 2 of ramp 1 partially compacts a line 7 between horizontal portion 5 of pavement mat 6 and tapered portion 2 of ramp 1. This compaction makes it very difficult or impossible to discern the actual edge of mat 6 during laying of a second pavement mat 8, shown in phantom in FIG. 1A. As a result, either ramp 1 must be removed or very precise paving machine operation is required to follow an almost non-existent edge 7 of first pavement mat 6. When second pavement mat 8 is laid over ramp 1, frequently the result is a feathered joint 9 where second pavement mat 8 lays over ramp 1 but does not have its edge meet cleanly with edge 7 of first pavement mat 6, i.e., either second pavement mat 8 is short of edge 7 or passes over edge 7. Feathered joint 9 is problematic because it may include a visible rut between pavement mats that can lead to deterioration and ravel under traffic. Additionally, water may gain easy access through feathered joint 9 and under second pavement mat 8 which may cause roadway heaving or separation problems.

Second, full compaction is oftentimes only applied to the horizontal part of first pavement mat 6. Tapered portion 2 of ramp 1 is normally only exposed to that compaction provided by the screed that forms it and whatever traffic crosses it. See e.g., U.S. Pat. No. 4,181,449 to Lenker, and U.S. Pat. No. 4,818,140 to Carlson. As a result, tapered portion 2 includes a low density area 10 which by the time second pavement mat 8 is laid has cooled and is extremely resistant to further compaction. Second pavement mat 8 does not contain a sufficient amount of hot material over low density area 10 to allow further compaction. The resulting joint therefore is immediately suspect.

Third, because the outermost extent of tapered portion 2 must be created by pavement material at its core particle size, e.g., small stones, it is oftentimes impossible to construct the outermost extent of tapered portion 2 such that it irremovably compacts into the rest of tapered portion 2 and/or adjacent/underlayer material 4. As a result, a loose aggregate safety problem persists.

Referring to FIG. 1B, the stepped tapered joint ramp was developed to alleviate the problems of raveling and edge following. By providing a step 12B at an edge 17 of new pavement mat 16, a feathered edge is prevented. Further, step 12B provides a defined line or edge 17 which alleviates the problem of having to follow an undecipherable compacted edge of first pavement mat 16. Unfortunately, the compaction problem for the tapered or wedge section 12 remains, i.e., a low density area 20 that is resistant to compaction exists. Further, if the proper height for step 12B is not incorporated, e.g., because different asphalt formulations have different compaction ratios, step 12B can be rolled out of existence when the rest of first pavement mat 16 is compacted.

One remedy for the joint creation problems of ramps has been to remove the ramps prior to laying the second pavement mat. Unfortunately, this process is very time consuming and difficult because the material has cooled and hardened. It may also necessitate additional lane closure to accommodate equipment.

In view of the foregoing, there is a need for a paving machine and pavement edger therefor which allow for accommodation of drop off from a new pavement mat and the creation of solid pavement joints.

SUMMARY OF THE INVENTION

In a first general aspect of the invention is provided a pavement edge maker comprising: a first compaction surface and a second compaction surface, the first compaction surface being offset vertically from the second compaction surface by a substantially vertical third compaction surface.

In a second general aspect of the invention is provided a paving machine comprising: means for laying a pavement mat having an edge; and means, coupled to the means for laying an asphalt mat, for forming a highly compacted step on the edge of the mat and a tapered portion extending away from a vertical face of the step, the tapered portion including a highly compacted area.

In a third general aspect of the invention is provided a pavement edger adapted for connection to a screed for creating an edge on an end of a mat of pavement, the edger comprising: a step making surface for making a compacted step; a ramp making surface for making a compacted tapered ramp adjacent to the compacted step; and a retraction mechanism to retract the step making surface and ramp making surface flush with the screed.

Using the above paving machine and pavement edger solves many of the above described problems of the prior art. First, the ramp provided in accordance with the present invention eliminates the drop off at an edge of a new pavement mat. Hence, time constraints, traffic, equipment shortages, etc., are no longer problematic. The safety problems associated with drop offs are also resolved and all federal and state highway contracting regulations can now be met with ease. The problems associated with the beginning or ending of a mat are resolved as the edger in accordance with the invention may be connected to the screed in such a way as to be self-enabling. Because the ramp includes highly compacted areas, the joint creating problems such as: rounded edges from traffic creating feathered joints; lack of full compaction because of hardened and compaction resistant tapered portions, are resolved. Furthermore, there is no longer a need to remove ramps.

Another embodiment of the present invention provides a pavement edger and joint member with height indicators, an adjustment apparatus including a shear pin, an angled pivotal attachment of a wedge section with a joint maker section, and an extension section attached to the wedge section.

The present invention also provides a paving machine comprising:

a system for providing precompaction of a paving material;

a system for providing horizontal shear compaction of the paving material; and a system for providing primary compaction of the paving material.

The foregoing and other features and advantages of the invention will be apparent from the following more particular description of preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

Figure 1A:
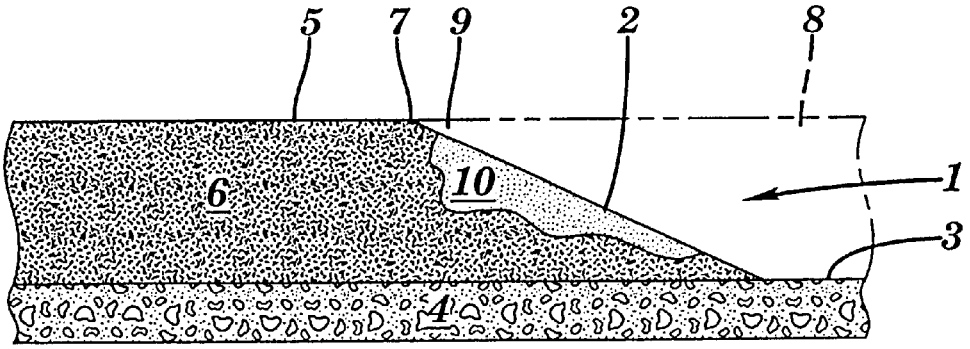
FIG. 1A PRIOR ART
FIGS. 1A–1B are side views of related art pavement mat edges.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

For definition herein, a "mat" or "pavement mat" is considered a layer of paving material. A "step" is considered an offset area where a substantially vertical surface meets another surface. "Paving material" is any material used for paving roadways, such as bituminous material like asphalt.

Figure 11:
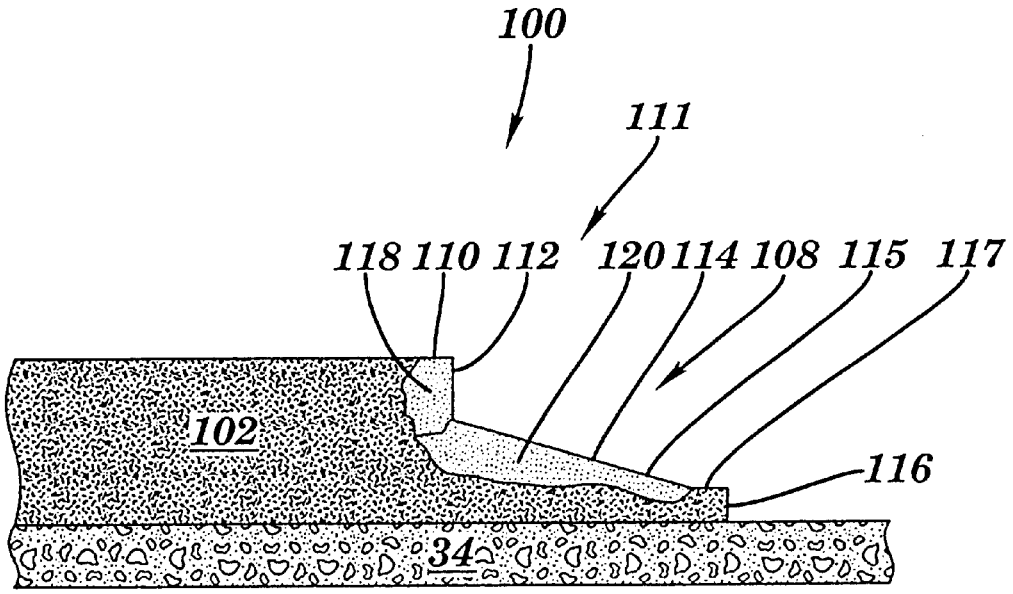
FIG. 11 is a cross-sectional view of a pavement ramp created with the edger in accordance with the invention.

For initial reference, attention is directed to FIG. 11 which illustrates a ramp 100 created in accordance with the present invention. Ramp 100 includes a step 111 on an edge 110 of pavement mat 102 and a tapered portion 108 extending away from a vertical face 112 of step 111. Step 111 and at least a section, e.g., upper end 114, of tapered portion 108 are compacted between 85% and 93% of complete compaction of the paving material to create highly compacted areas 118, 120. By "highly compacted" is meant that paving material is compacted between 85% to 93% of its complete compaction, a percentage higher than if paving material was simply leveled by a screed 40. Screeding normally only provides a compaction rate of 80% or less. A second step 116 is also provided at a lower end 115 of tapered portion 108. Tapered portion 108 may also include a flattened portion 117 at lower end 115. Ramp 100 will be discussed in more detail below.

Figure 2:
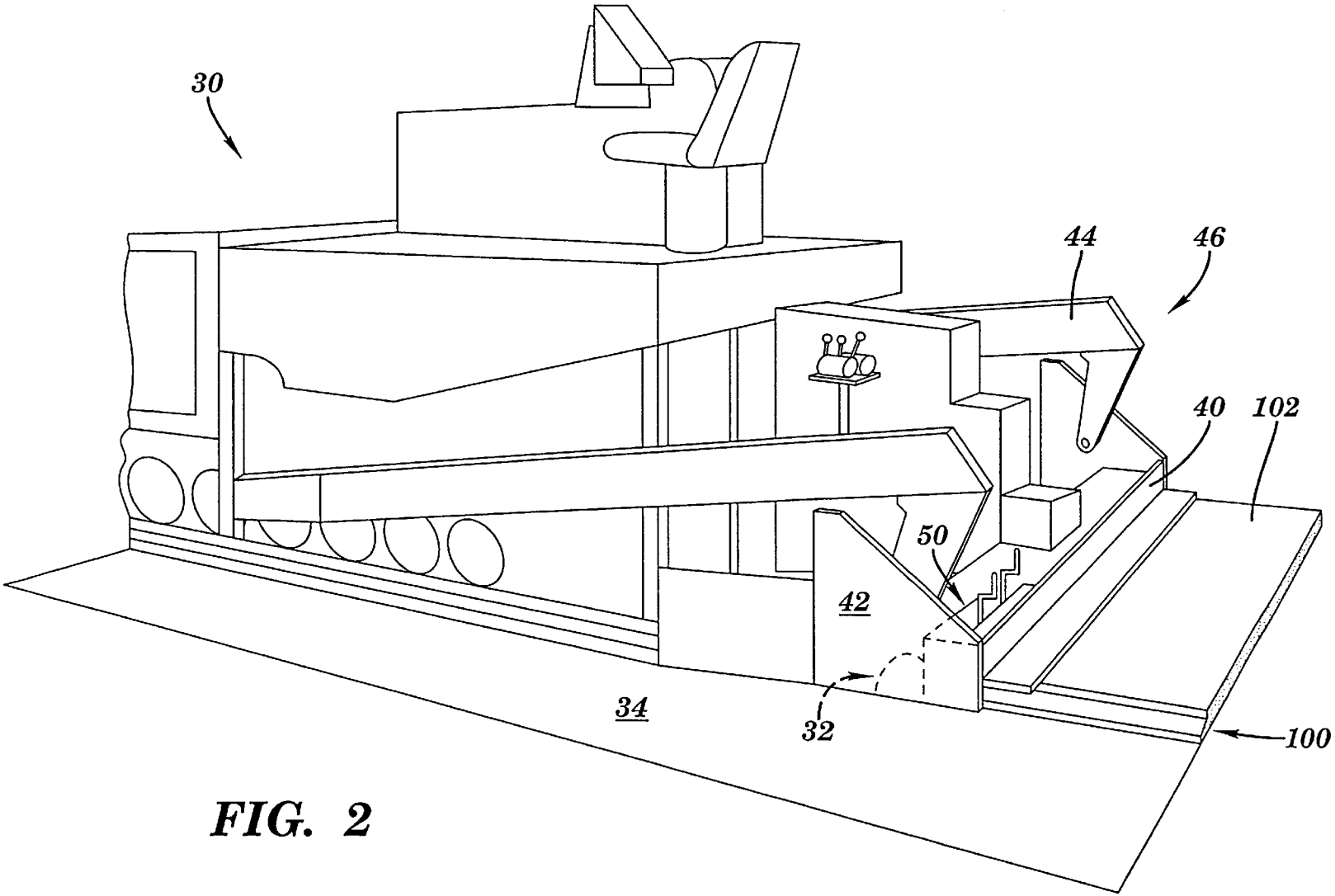
FIG. 2 is a perspective view of a paving machine equipped with an edger in accordance with the present invention.

Referring to FIG. 2, a paving machine 30 equipped with an edger or pavement edge maker 50 of the present invention is illustrated operating to spread and grade paving material 32, e.g., a paving road mix such as asphalt, etc., on an adjacent surface 34 to form pavement mat 102 with a ramp 100 on its edge or shoulder. The paving machine 30 has a rear main screed 40 extending from an upright moldboard 42. Elevation of screed 40 is determined by adjustment of a pair of tow arms 44 pivotally connected to a supporting frame 46 for moldboard 42 and screed 40. Asphalt mix carried by paving machine 30 is spread laterally in front of moldboard 42 by augers (not shown) which are spaced forwardly of moldboard 42. Paving machine 30 may also include an optional screed extender 48 (FIGS. 4–7) to extend screed 40 and/or a vertically adjustable end gate 49 (FIGS. 3–7), as are commonly known in the art. End gate 49 may include a vertically adjustable sled 47, as is conventional.

Referring to FIGS. 3–8, edger 50 is illustrated in more detail. Edger 50 includes a first compaction surface 52, a second compaction surface 53 and a third substantially vertical compaction surface 54. Compaction surfaces 52, 53, 54 are preferably constructed of metal plating, e.g., steel plating. Compaction surfaces 52, 53, 54 have a special alignment to create ramp 100 in accordance with the present invention. In particular, compaction surfaces 52, 53 are angled upwardly at an angle $\alpha$ relative to a forward direction of travel A of paving machine 30 to receive and compact paving material 32 thereunder. Similarly, third compaction surface 54 is also angled upwardly at angle $\alpha$ along a lower edge 59 thereof. The angle $\alpha$ is less than 45° so as to allow receipt and compaction of paving material 32 without plowing thereof. First compaction surface 52 is fixed relative to edger mounting plate 88 and may include support structure 55 between a back surface thereof and an edger mounting plate 88. Compaction surfaces 53, 54 are vertically adjustable relative to first compaction surface 52 as will be further described below.

Figure 3:
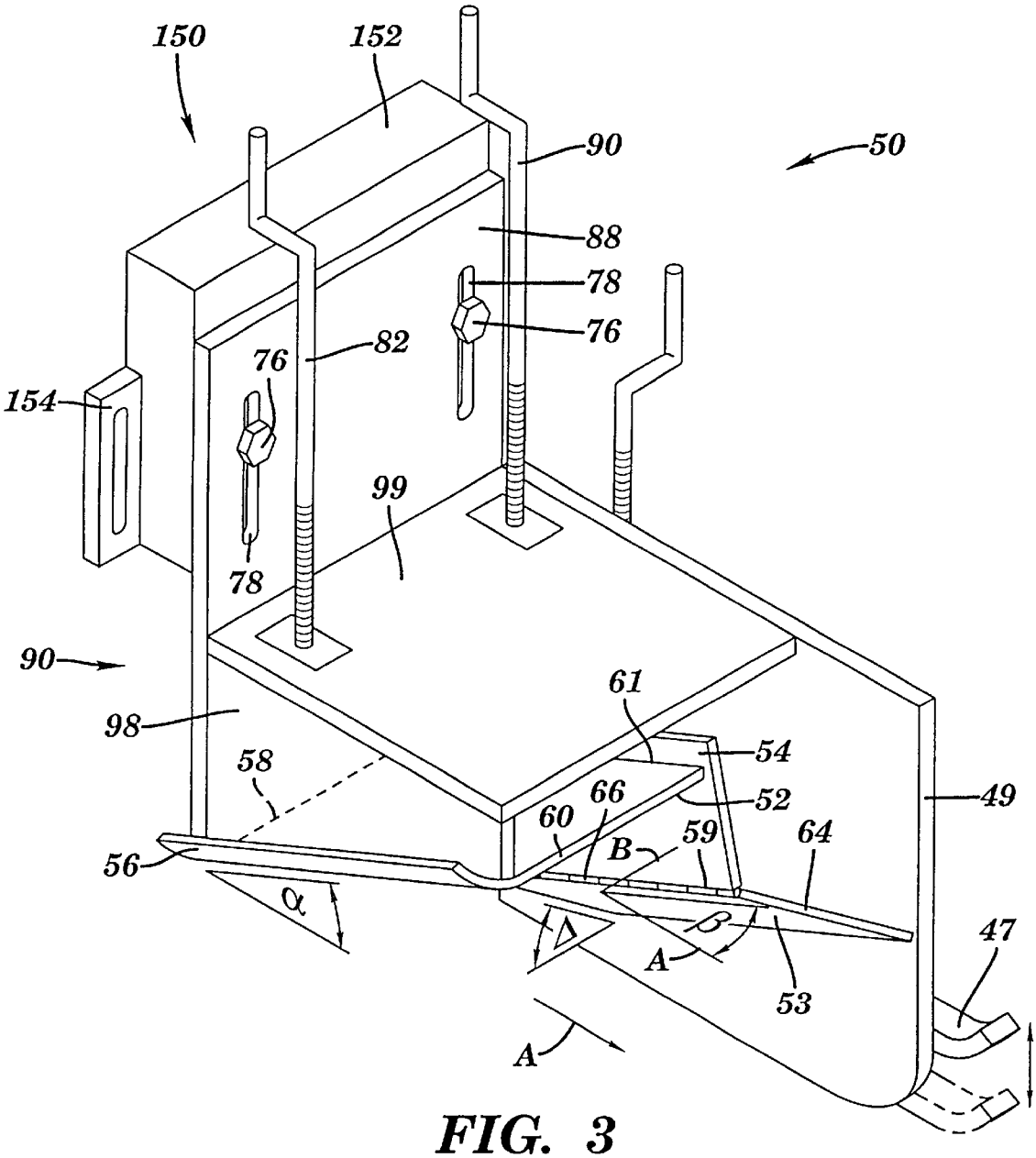
FIG. 3 is a front perspective view of the edger.
Figure 4:
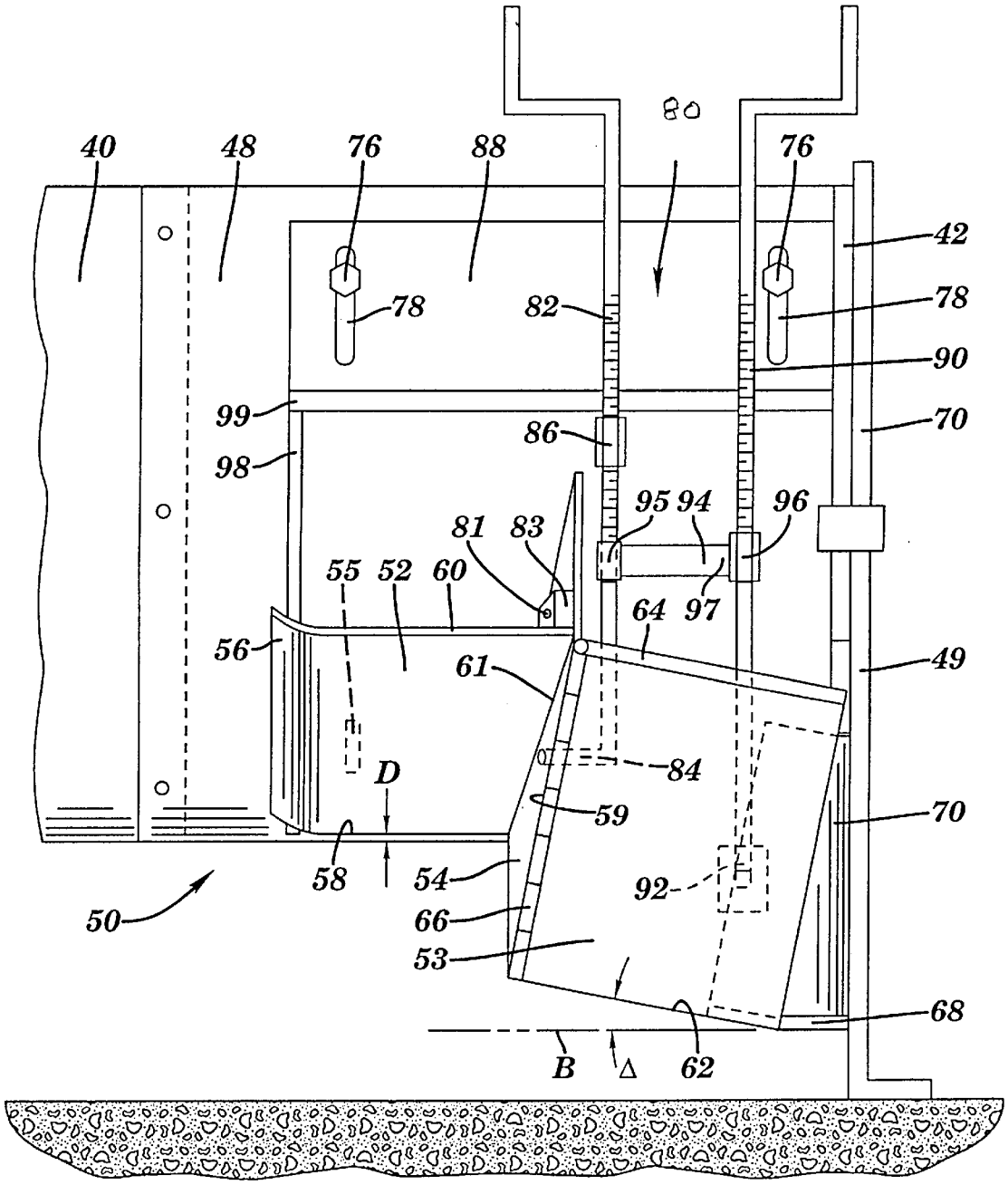
FIG. 4 is a front elevational view of a first embodiment of the edger mounted to the paving machine.
Figure 5:
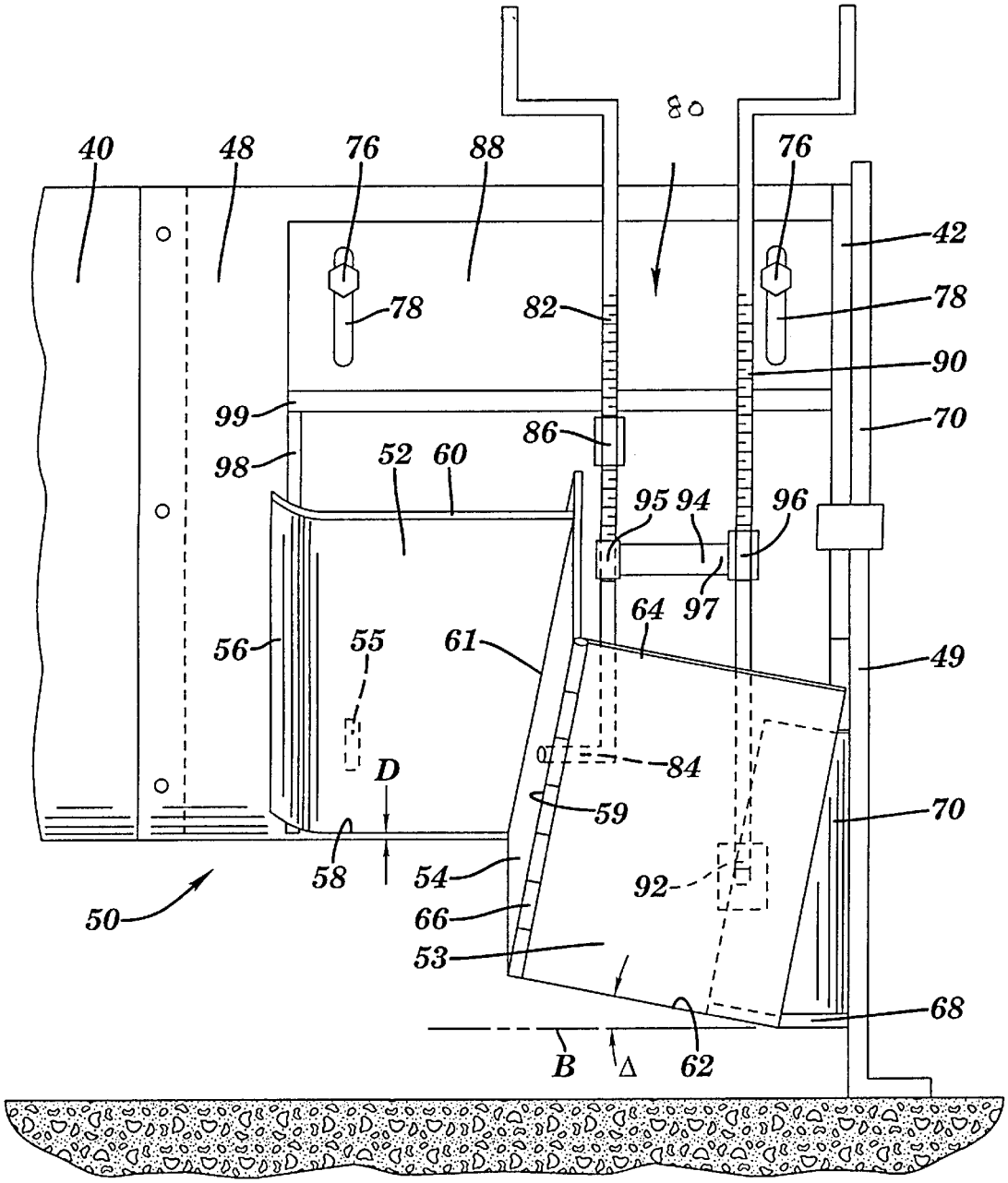
FIG. 5 is a front elevational view of a second embodiment of the edger mounted to the paving machine.

Third compaction surface 54 is substantially vertical, as best seen in FIGS. 4–5, and is also angled in a horizontal lateral direction B at an angle $\beta$, as best seen in FIG. 3. Horizontal lateral angle $\beta$ allows compaction surface 54 to receive and compact paving material 32 horizontally to form substantially vertical face 112. To accommodate angle $\beta$ and to prevent material from passing between first and third compaction surfaces 52, 54, first compaction surface 52 includes mating angled edge 61 created by having a rearward lower edge 58 shorter than a forward upper edge 60. Similarly, second compaction surface 53 may also include a rearward lower edge 62 that is longer than a forward upper edge 64 to accommodate angle $\beta$ and to assure that outermost edge 70 of second compaction surface closes against end gate 49 when retracted, as will be discussed below. First compaction surface 52 may also include a curved edge 56 to accommodate paving material 32 adjacent thereto.

As best shown in FIGS. 4–5, rearward lower edge 62 of second compaction surface 53 is angled at an angle $\Delta$ relative to horizontal lateral direction B to create tapered portion 108, as will be described below. Second compaction surface 53 is preferably pivotally mounted to third compaction surface 54 by a hinge 66 to allow for adjustment of angle $\Delta$. Adjustment of angle $\Delta$ has two effects: first, it alters angle $\Delta$ of tapered portion 108, and second, either alone or in combination with vertical adjustment, it varies the height of second step 116 on lower end 115 of tapered portion 108. Second step 116 is created between second compaction surface 53 and end gate 49, which acts as a fourth compaction surface.

Figure 10:
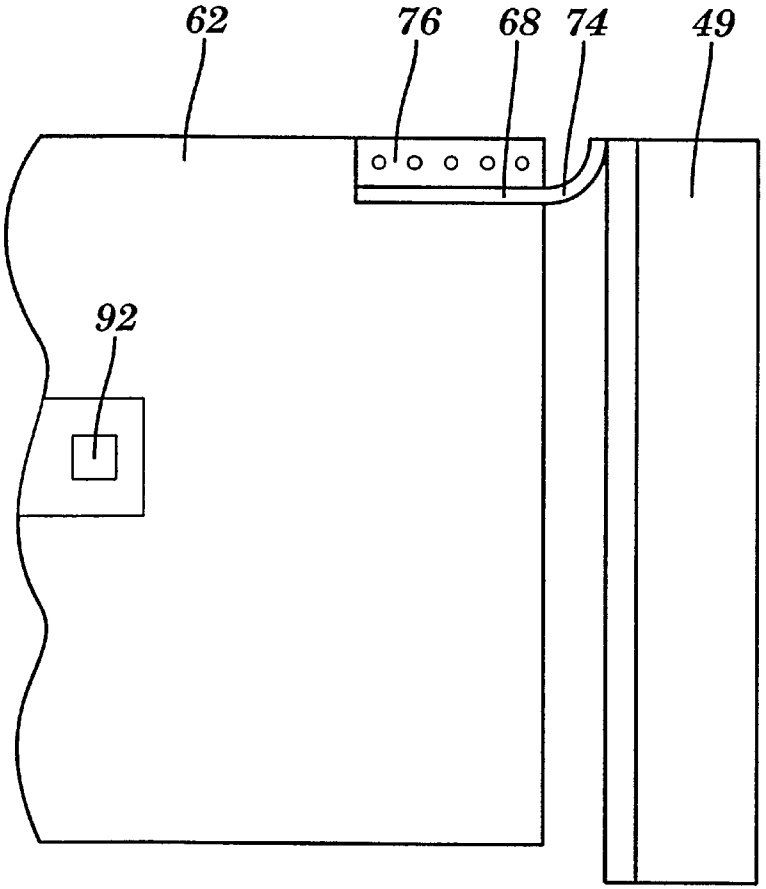
FIG. 10 is a top view of the strike off on the edger.
Figure 9:
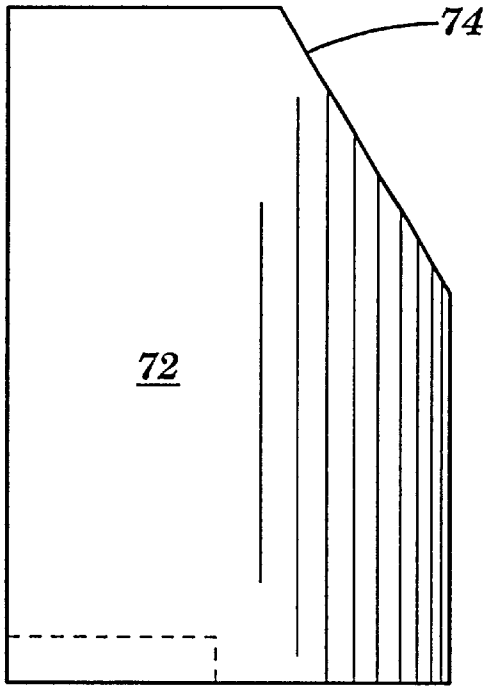
FIG. 9 is a front elevational view of a flexible seal strike off for the edger in accordance with an embodiment of the invention.

Angular adjustment of second compaction surface 53 relative to either moldboard 42 or optional end gate 49, along with vertical movement of optional end gate 49, may create a gap between second compaction surface 53 and the above structures. To prevent passage of paving material 32 therethrough, a flexible seal strike off 68 is provided on outer edge 70 of second compaction surface 53. As shown in FIGS. 9 and 10, flexible seal strike off 68 is preferably a flexible sheet of spring steel 72 having a beveled corner 74 and a connection flap 76. Strike off 68 is attached, e.g., by welding, bolting, etc., by connection flap 76 to second compaction surface 53 and extends generally upwardly therefrom. As angle $\Delta$ of third compaction surface 53 and/or vertical movement of end gate 49 varies, strike off 68 flexes to accommodate the gap and maintain a strike off surface, as best shown in FIGS. 4–5 and 10. If end gate 49 is ever raised above second compaction surface 53, beveled corner 74 allows for re-mating and gradual flexing of strike off 68 against end gate 49.

Referring to FIGS. 4–5, edger 50 also preferably includes an adjustment system 80. Adjustment system 80 can adjust the depth of third compaction surface 54 and second compaction surface 53, relative to first compaction surface 52; adjusts angle $\Delta$ of second compaction surface 53; and can also operate as a retraction mechanism for second and third compaction surfaces, 53, 54 as will be described below. Adjustment is preferable to accommodate varying system characteristics, e.g., different paving material 32 having different compaction ratios, change in atmospheric temperature, different screeds, screed extenders or end gates, etc. Preferably, adjustment system 80 is adjustable to allow for pavement mats with a thickness ranging from approximately 1 inch to 5 inches uncompacted, i.e., 34 inches to 4 or more inches compacted. It should be recognized, however, that if characteristics are known to be constant or fairly constant, that a fixed device is considered within the scope of the invention. In this circumstance, compaction surfaces 52, 53, 54 would be fixed in position. Strike off 68, if necessary, would also be fixed, e.g., a welded plate.

Figure 12:
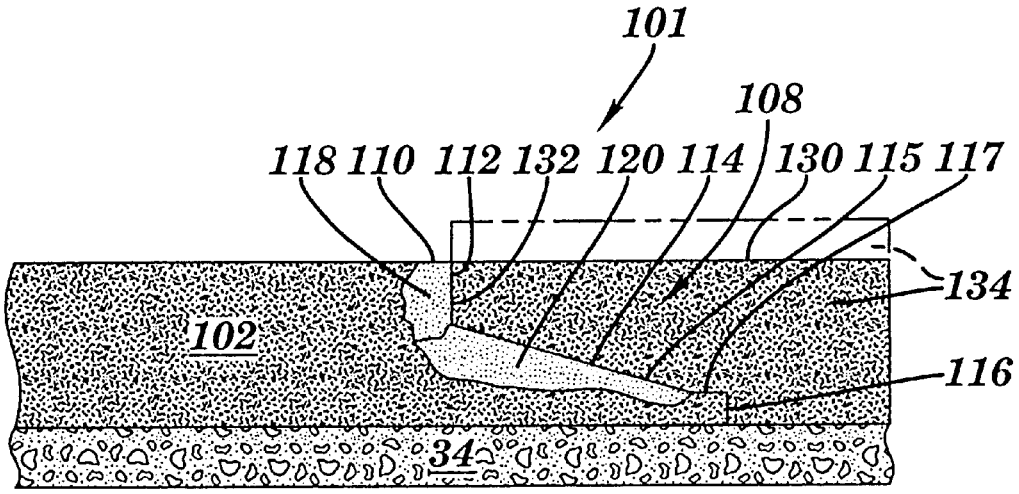
FIG. 12 is a cross-sectional view of a joint in accordance with the present invention.

Retraction is preferable because it allows edger 50 to operate as an edger and as a screed joint maker for creation of joint 101 of FIG. 12. Hence, edger 50 can crate ramp 100 and also joint 101 without having to remove any parts from paving machine 30 or edger 50.

In order to vertically adjust second and third compaction surfaces 53, 54, in a first preferred embodiment shown in FIG. 4, adjustment system 80 includes a threaded vertical adjustment crank 82 which is fixedly attached at a lower end 84 thereof to third compaction surface 54. Vertical adjustment crank 82 threads into a threaded mount 86 fixedly coupled to edger mounting plate 88. Third compaction surface 54 is pivotally coupled to a pivot plate 81 which is fixed to first compaction surface 52. A pivot pin 83 extends through pivot plate 81 into third compaction surface 54. By turning vertical adjustment crank 82, second and third compaction surfaces 53, 54 are vertically adjusted as crank 82 is held by threaded mount 86. Third compaction surface 54 may include a rounded rear edge to accommodate pivoting motion, if necessary.

Figure 6:
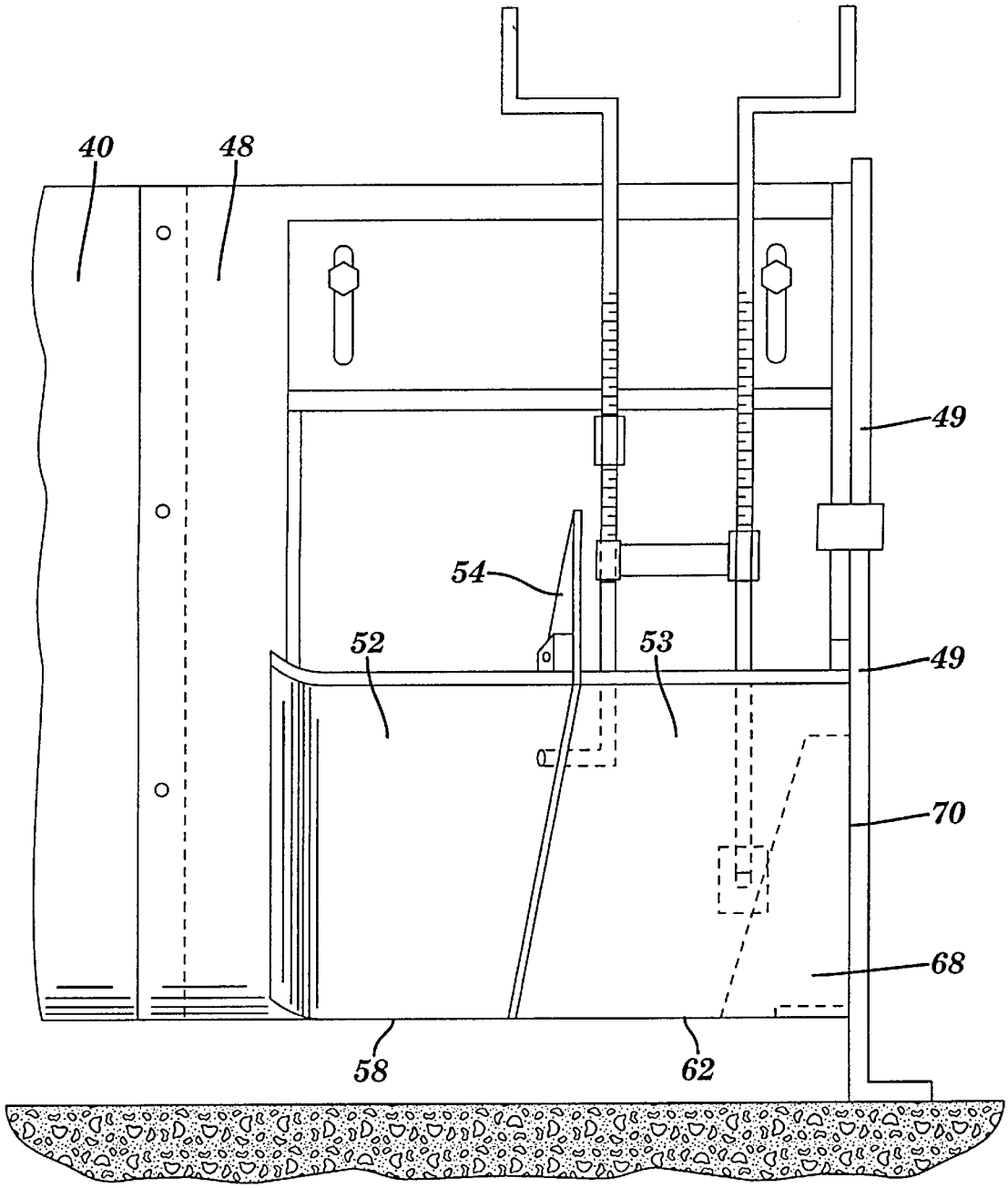
FIG. 6 is a front elevational view of the edger in a retracted position.

As shown in FIG. 6, second and third compaction surfaces 53, 54 can also be retracted such that their lowermost edges are even or flush with rearward edge 58 of first compaction surface 52 and/or screed 40 an/or screed extender 48. The edges that second and third compaction surface 53, 54 will be flush with will depend on the vertical positioning of edger 50 by a vertical positioning system 150, discussed below, and the degree of retractability of surfaces 52, 54. In its fully retracted position, outermost edge 70 of second compaction surface 53 is substantially flush with an inner surface of end gate 49 such that flexible seal strike off 68 is not in use. In this retracted position, edger 50 need not be removed during the laying of a second pavement mat 130, as shown in FIG. 12, and can operate as a joint maker.

Referring to FIG. 5, an alternative embodiment for vertical adjustment is shown. In this embodiment, rear edges of second and third compaction surfaces 53, 54 may be held to edger mounting plate 88 by channels (not shown) or other structure to allow for translational vertical movement. Otherwise, vertical adjustment works in the same way as with the first embodiment.

Adjustment system 80 also includes angular adjustment crank 90 to vary angle Δ of second compaction surface 53. As noted above, second compaction surface 53 is pivotally attached to lower edge 59 of third compaction surface 54 by a hinge 66. At a lower end 92, angular adjustment crank 90 is fixedly and pivotally attached to second compaction surface 53 on an upper side thereof. Angular adjustment crank 90 also is coupled to vertical adjustment crank 82 by element 94. Element 94 is fixedly attached at one end 95 to vertical adjustment crank 82 and holds threaded mount 96 for angular adjustment crank 90 at a second end 97. As vertical crank 82 is moved, angular adjustment crank 90 and, hence, second compaction surface 53, moves with vertical crank 82 because of element 94. To adjust angle Δ, crank 90 is turned to either increase or decrease the distance between second compaction surface 53 and threaded mount 96. As noted above, adjustment of angle Δ has two effects: it alters the angle of tapered portion 108, and it varies the height of second step 116 on lower end 115 of tapered portion 108. Hence, either vertical or angular adjustment can vary the height of step 116.

It should be recognized that while a particular adjustment system 80 has been illustrated, that a variety-of different mechanisms are possible. Accordingly, the scope of this invention should not be limited to any particular adjustment mechanism. It should also be recognized that any other structural elements that may be necessary to retain compaction surfaces 52, 53, 54 in proper positioning may also be provided. For instance, channel members (not shown) may be provided on edger mounting plate 88 to mate with parts of compaction surfaces 52, 53, 54, e.g., channel slide members, to direct movement and retain the surfaces relative to edger mounting plate 88.

Edger 50 can be mounted to a front side of screed 40 or screed extender 48 by edger mounting plate 88 and an adjustable system of bolts 76 and slots 78, as shown in FIGS. 3–5. It should be recognized, however, that any system which allows for quick connection of edger 50 to screed 40 or screed extender 48 may be utilized. A quick connection is preferable because edger 50 may have to be removed for transport, especially when mounted in screed extender 48.

Figure 8:
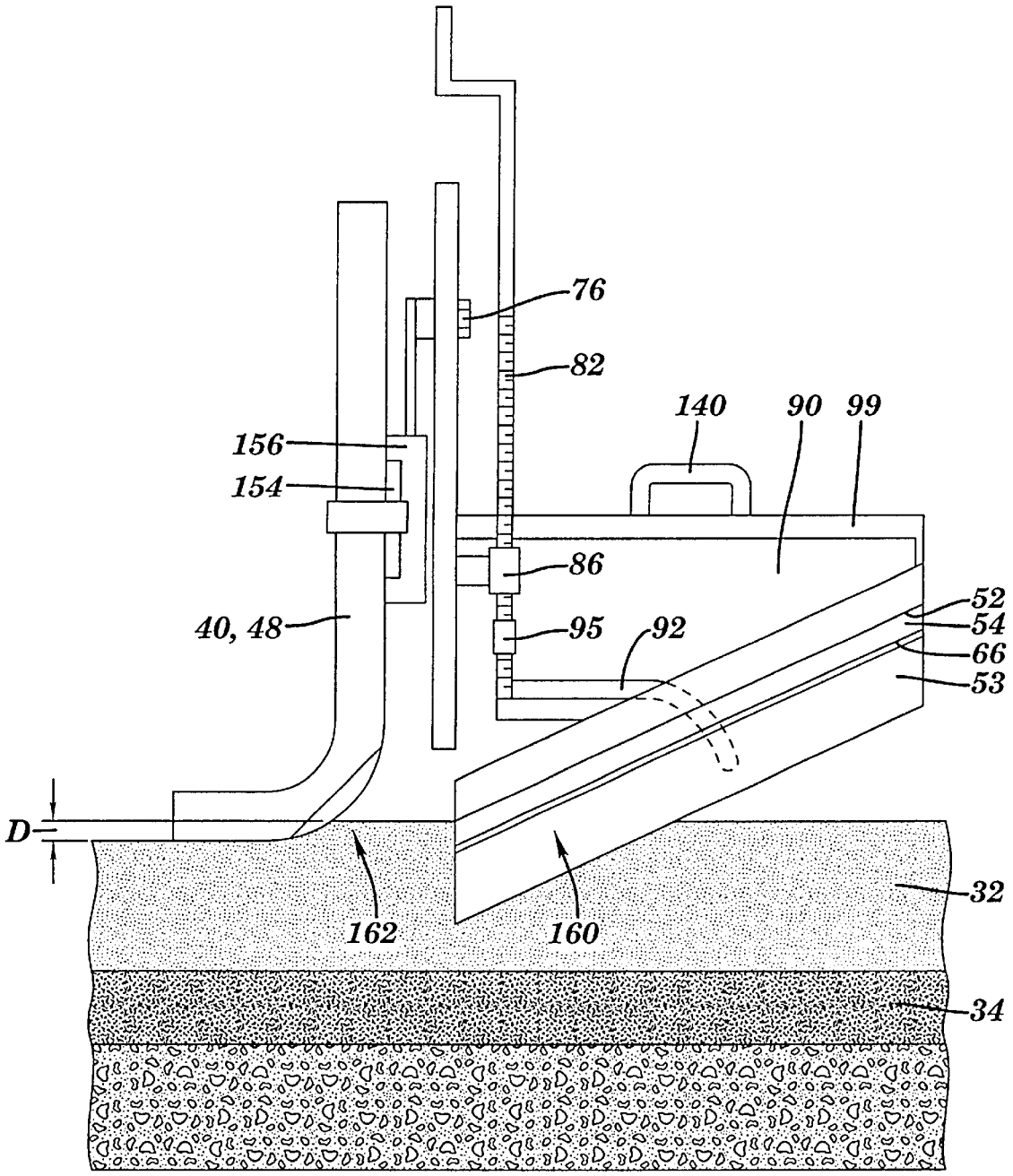
FIG. 8 is a side elevational view of the edger in operation as viewed from within the screed.

In a preferred embodiment, edger 50 is mounted to screed 40 or screed extender 48 by an edger positioning system 150, as shown in FIGS. 3 and 8. Edger positioning system 150 can be any device 152 that allows vertical adjustment of edger 50 relative to screed/extender 40, 48. Vertical adjustment is required for start up and ending a pavement mat, or paving on or off bridges. In a preferred embodiment, edger positioning system 150 is constituted by a hydraulic ram system 156, as shown in FIG. 8. Other possibilities, for edger positioning system 150 are spring biased systems, or motorized systems, etc. Edger positioning system 150 can be mounted to screed 40 or screed extender 48 by a bolt and slot systems 154, or the above mentioned quick connect systems (not shown).

In pavement mat starting operation, end gate 49, screed 40 and screed extender 48, if provided, would be in contact with adjacent surface 34. If edger positioning system 150 is an automatic type device, e.g., a hydraulic ram system 156, it is preferable to have edger 50 positioned out of contact with adjacent surface 34, i.e., with second compaction surface 53 out of contact. Alternatively, if edger positioning system 150 is a spring-biased system, edger 50 may be in ground contact and biased upwardly. As paving machine 30 proceeds to begin paving operations, screed 40 and screed extender 48, if provided, are raised. Simultaneously, end gate 49 lowers, either controllably or by its own accord as is common in the art, to maintain ground contact. At this time, edger positioning system 150 operates to correctly position edger 50 relative to screed 40. For instance, if edger positioning system 150 is a spring-biased system, edger 50 being raised with screed 40 out of ground contact would allow the springs (not shown) to bias edger 50 downwardly to a correct position, possibly set by an adjustable stop. If edger positioning system 150 is a hydraulic ram system 156, then hydraulic ram system 156 can be activated to position edger 50 correctly. In pavement mat ending operation, edger positioning system 150 would operate in reverse order as discussed above, i.e., raising edger 50 out of ground contact as screed 40 and screed extender 48, if provided, are lowered.

Edger 50 may also include a side 98 and cover 99 to enclose the side, top and front of edger 50. Cover 99 may include a handle 140, as shown in FIG. 8, for ease of transport of edger 50.

Figure 7:
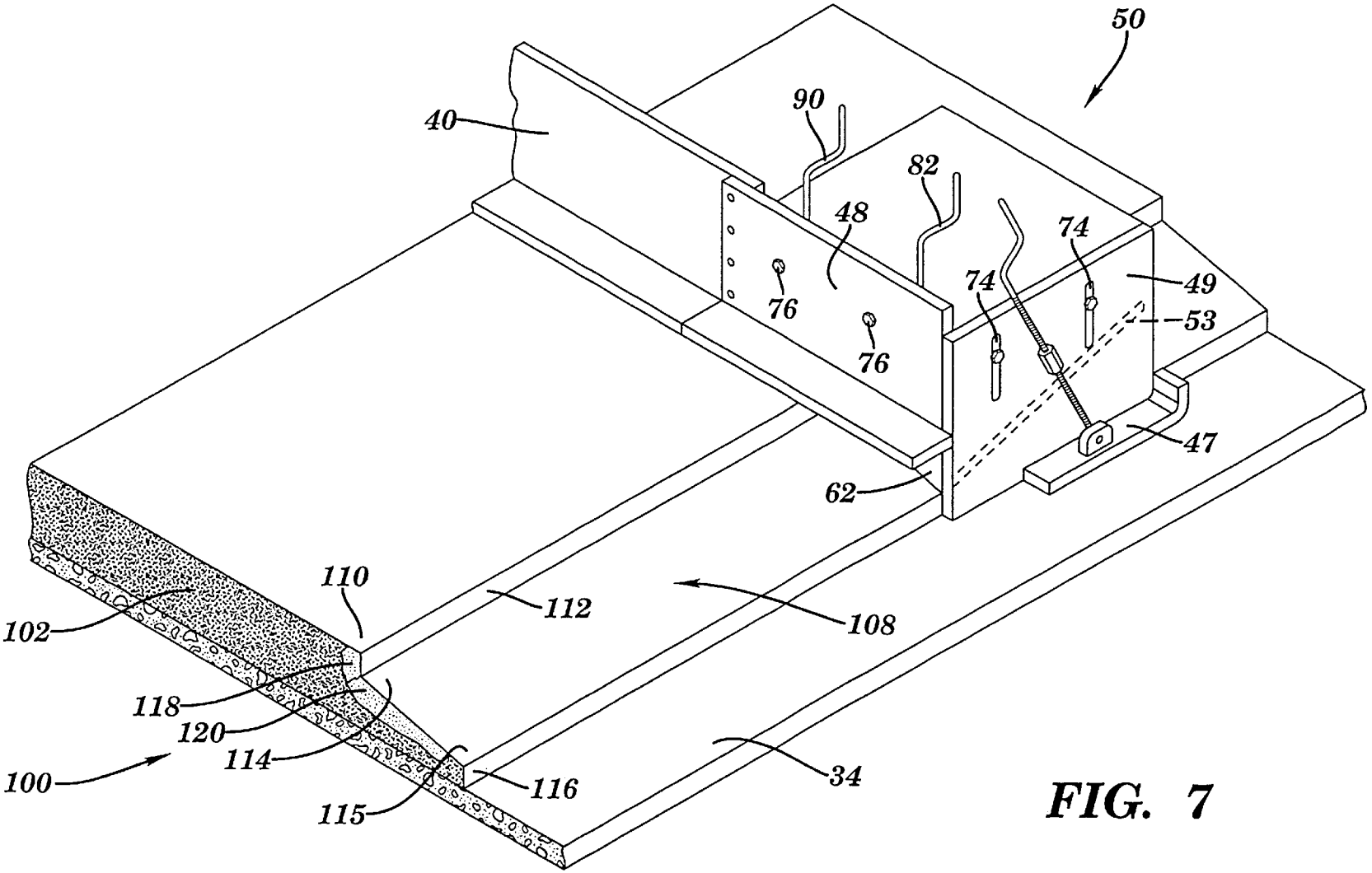
FIG. 7 is a rear perspective view of the edger in operation.

Referring to FIGS. 7, 11 and 12, operation of edger 50 to create ramp 100, illustrated in FIG. 11, will be described. Edger 50 is mounted either inside screed 40 or screed extension 48. Vertically movable end gate 49 may be added, if desired. As paving machine 30 proceeds, paving material 32 is heated and laid out in front of screed 40 which levels most of paving material 32 into a pavement mat 102. At an edge 110 of pavement mat 102, edger 50 works to create ramp 100 in accordance with the present invention. In particular, first compaction surface 52 vertically compacts a top surface of edge 110 of pavement mat 102. Simultaneously, substantially vertical third compaction surface 54 horizontally compacts substantially vertical face 112 of edge 110. In combination, first and third compaction surfaces 52, 54 provide a highly compacted step 111 having a highly compacted portion 118. Again, "highly compacted" means that paving material 32 is compacted between 85% to 93% of its complete compaction, a percentage higher than if material 32 was simply leveled by screed 40.

As will be observed in FIGS. 4–5 and 8, it is preferable to mount edger 50 such that rearward lower edge 58 of first compaction surface 52 is a distance D above the bottom of screed 40 or screed extender 48. In this way, a pre-compaction zone 160 is created beneath edger 50 and a primary compaction zone 162 is created beneath screed 40 or screed extender 48. It should be recognized, however, that rearward lower edge 58 of first compaction surface 52 need not be above the bottom of screed 40 or screed extender 48 to attain the advantages of the present invention.

At the same time that step 111 is being formed, second compaction surface 53 is also forming and compacting tapered portion 108 having an upper end 114 and a lower end 115. Second compaction surface 53 is positioned vertically and angled so as to highly compact tapered portion 108 and form a highly compacted area 120 therein. Preferably, tapered portion 108 also includes a second step 116 at lower end 115 thereof. Second step 116 is formed against moldboard 42 or end gate 49 which acts as a fourth compaction surface. Second step 116 prevents loose aggregate from being left behind as in prior art devices. It will also be noticed that if a gap is present between second compaction surface 53 and end gate 49, strike off 68 will create a flattened portion 117 at lower end 115 of tapered portion 108.

In view of the foregoing, the process of producing ramp 100 includes: forming highly compacted step 111 on edge 110 of first pavement mat 102 by horizontally compacting substantially vertical face 112 and by vertically compacting a top surface of first pavement mat 102; and forming a tapered portion 108 extending away from substantially vertical face 112 of step 111 with tapered portion 108 including a at least a section or area 120 that is highly compacted. Highly compacted areas 118, 120 are compacted between 85% and 93% of complete compaction. As an option, another step 116 may be formed at a distal end 115 of tapered portion 108 from substantially vertical face 112. Further, pavement mat 102 may be rolled to a more complete compaction, e.g., up to approximately 98% of complete compaction as a finishing step.

Referring to FIG. 12, a joint 101, created with paving machine 30 and edger 50, in accordance with the present invention is illustrated.

Joint 101 can be created using the above processes for creating ramp 100 of FIG. 11, followed by: laying a second pavement mat 130 adjacent first pavement mat 102 such that an edge 132 of second pavement mat 130 abuts substantially vertical face 112 of edge 110, and then compacting second pavement mat 130. The final compaction would be up to approximately 98% of complete compaction. Preferably, laying of second pavement mat 130 would include using edger 50 with second and third compaction surfaces 53, 54 retracted so as to form a contiguous joint maker surface. In this instance, edger 50 may be vertically adjusted to have its rearward lower edges 58, 62 even or flush with screed 40 or screed extender 48 so as to provide even compaction across the entire second pavement mat 130, and whatever part of first pavement mat 102 is covered. As an alternative, edger 50 could be removed and pavement mat 130 laid in a conventional manner.

As an alternative, processes are provided in accordance with the invention to create joint 101 from nothing as follows: First, lay first pavement mat 102 having edge 110. Pavement mat 102 can be leveled by a conventional screed 40. Next, form highly compacted step 111 on edge 110 of first pavement mat 102 and a highly compacted tapered portion 108 extending away from vertical face 112 of step 111. Highly compacted areas 118 and 120 are compacted between 85% to 93% of complete compaction. Pavement mat 102 may be rolled to a more complete compaction, e.g., up to approximately 98% of complete compaction. Last, a second pavement mat 130 is laid adjacent first pavement mat 102 such that an edge 132 of second pavement mat 120 abuts vertical face 112. Laying second pavement mat 130 includes leveling with a conventional screed.

Figure 1B:
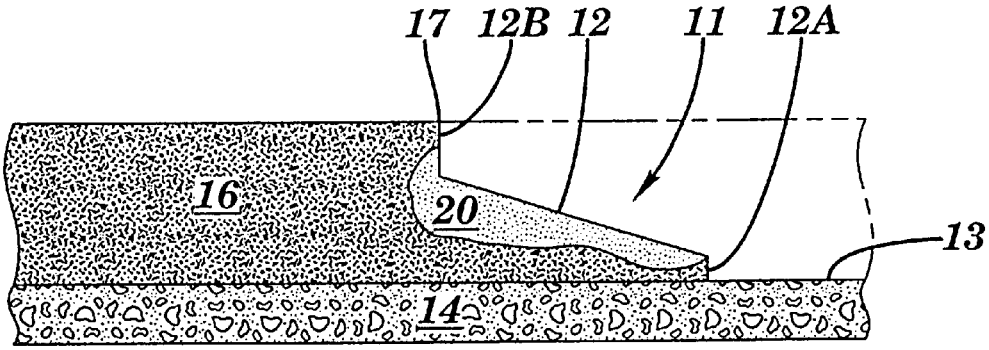
FIG. 1B PRIOR ART

It is to be recognized, that the presence of highly compacted areas 118, 120 provide an advantage to creation of joint 101. For instance, one will recognize that when second pavement mat 130 is laid, less material 134 is necessary over tapered portion 108. In normal non-highly compacted ramps/joints, as shown in FIGS. 1A and 1B, an upper section of tapered portion 2, 12 would include a low density area 10, 20. Low density area 10, 20, because of its thickness and the thinner amount of paving material in the second pavement mat atop of it, would not be sufficiently heated to accommodate further compaction. In contrast, in accordance with the present invention, upper end 114 of tapered portion 108 is already highly compacted and therefore does not need as much further compaction. Further, the thinner layer of material overlying upper end 114 provides sufficient heat to allow for finishing compaction of upper end 114 and the seam between vertical face 112 and edge 132 of second pavement mat 130.

Second pavement mat 130 is compacted in a conventional way from a level shown in phantom in FIG. 12 to form joint 101. Compaction at this point is up to approximately 98% of complete compaction. Adjacent to second step 116, second pavement mat 130 has the same thickness as first pavement mat 102.

The invention also includes joint 101 created by the above processes and including: a first asphalt section 102 mating with a second asphalt section 130 to form a substantially seamless joint with second asphalt section 130. Second asphalt section 130 including a first step 111 and a ramp portion 108 extending away from a lower portion of first step 111. First step 111 and a section 120 of ramp portion 108 are highly compacted prior to first asphalt section 102 mating with second asphalt section 130.

Figure 13:
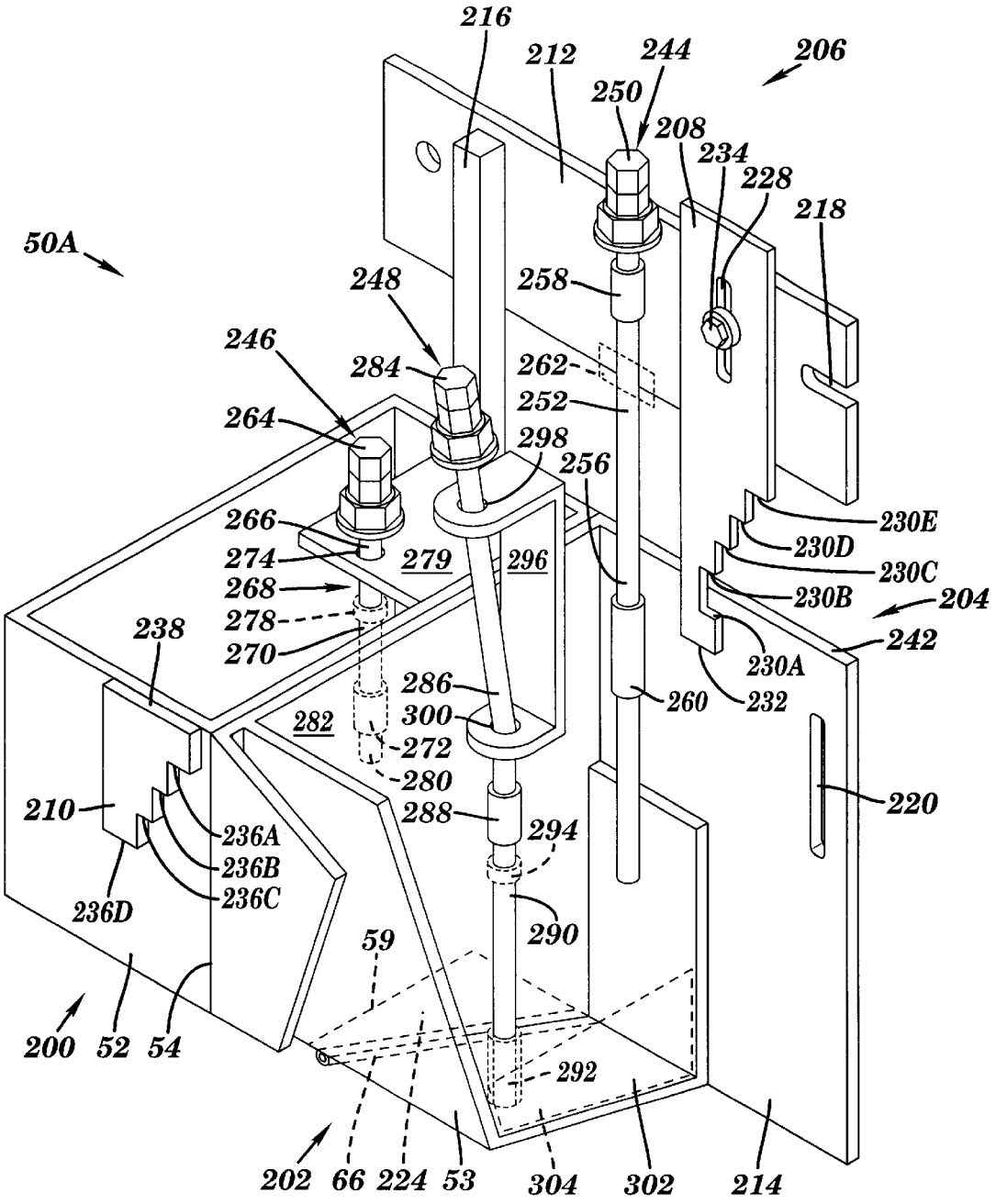
FIG. 13 illustrates a perspective view of another embodiment of an edger.
Figure 19:
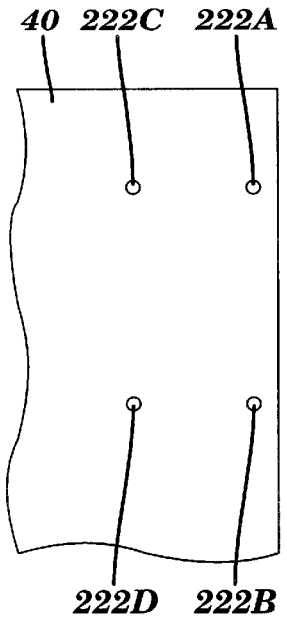
FIG. 19 illustrates a front view of the screed with mounting holes for the edger.

FIG. 13 illustrates a perspective view of another embodiment of an edger 50A of the present invention. The edger 50A includes a joint maker section 200, a wedge section 202, a mounting assembly 204, an adjustment apparatus 206, a height indicator 208, and a wedge location indicator 210. The mounting assembly 204 includes a top plate 212, a bottom plate 214, and a guide member 216. The top plate 212 includes a mounting opening 218. The bottom plate 214 includes a mounting opening 220. The guide member 216 slidingly connects the top plate 212 with the bottom plate 214. As illustrated in FIG. 19, the rear main screed 40 includes threaded holes 222A, 222B, 222C, and 222D. The top plate 212 of the mounting assembly 204 of the edger 50A is attached to the rear main screed 40 by a threaded portion of a first bolt (not shown) passing through the mounting opening 218 and into the threaded hole 222A. The bottom plate 214 of the mounting assembly 204 is attached to the rear main screed 40 by a threaded portion of a second bolt (not shown) passing through the mounting opening 220 and into the threaded hole 222B. The first bolt is fully tightened, and the second bolt is not fully tightened to allow vertical movement of the bottom plate 214.

As illustrated in FIGS. 4 and 13, the edger 50A in a manner similar manner to the edger 50 includes the first compaction surface 52, the second compaction surface 53 and the third substantially vertical compaction surface 54. Referring to FIG. 3, the compaction surfaces 52 and 53 are angled upwardly at an angle $\alpha$ relative to the forward direction of travel A of the paving machine 30 (FIG. 2) to receive and compact paving material 32 thereunder. Similarly, the third compaction surface 54 is also angled upwardly at angle $\alpha$ along the lower edge 59. The angle $\alpha$ is less than 45 degrees so as to allow receipt and compaction of paving material 32 without plowing thereof. The first compaction surface 52 is fixed relative to the bottom plate 214 (FIG. 13). Compaction surfaces 53 and 54 are vertically adjustable relative to the first compaction surface as will be further described below. A flexible boot 304 (shown in phantom) may be attached to the wedge section 202 as illustrated in FIG. 13. The flexible boot 304 prevents paving material 32 from leaking out of the wedge section 202. The flexible boot 304 can be made from any suitable material such as rubber or metal.

The third compaction surface 54 is substantially vertical, as best seen in FIGS. 4 and 5, and is also angled in a horizontal lateral direction B at an angle $\beta$, as best seen in FIG. 3. Horizontal lateral angle $\beta$ allows compaction surface 54 to receive and compact paving material 32 horizontally to form the substantially vertical face 112.

Figure 14:
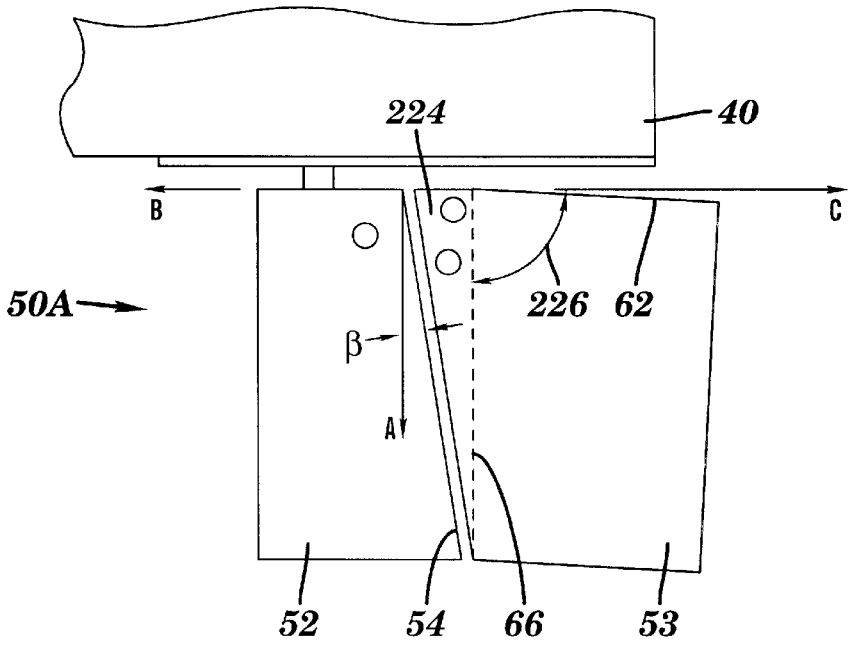
FIG. 14 illustrates a plan schematic view of the edger with an angled hinge connecting a wedge section with a joint maker section.

FIG. 14 illustrates a plan schematic view of the edger 50A and shows the horizontal lateral angle $\beta$ between the direction of travel A and the substantially vertical compaction surface 54. The paving material 32 is compacted in the horizontal direction B which creates horizontal shear compaction in the material and results in the highly compacted area 118 (FIG. 11) with compaction density of between about 85% and 93% of complete compaction.

FIGS. 13 and 14 illustrate the hinge 66 whereby the second compaction surface 53 is attached to a wedged shaped section 224. The wedged shaped section 224 is attached to the lower edge 59 of the third compaction surface 54 (FIG. 13). As illustrated in FIG. 14 a horizontal line C is parallel to the screed 40. The angle 226 between the line C and the hinge 66 is greater than 90 degrees to ensure that the rearward lower edge 62 of the second compaction surface 53 never contacts the screed 40 as the second compaction surface 53 moves in an upward or downward direction.

The height indicator 208 is illustrated in FIG. 13. The height indicator 208 includes a slot 228 and a plurality of surfaces 230A, 230B, 230C, 230D, 230E, and a lower surface 232. The plurality of surfaces 230A, 230B, 230C, 230D, 230E are each spaced a predetermined distance (e.g., at one inch intervals) above the lower surface 232. A bolt 234 passes through the slot 228 and attaches the height indicator 208 to the top plate 212. The bolt 234 can be loosened to allow the height indicator 208 to be vertically positioned at a selected height and then the bolt 234 is tightened to hold the height indicator 208 at the selected height.

The wedge location indicator 210 is illustrated in FIG. 13. The wedge location indicator 210 includes a plurality of surfaces 236A, 236B, 236C, 236D and an upper surface 238. The wedge location indicator 210 is attached to the joint maker section 200. The surfaces 236A, 236B, 236C, 236D are spaced a predetermined distance (e.g., at one inch intervals) below the upper surface 238. Each surface 236A–236D indicates the vertical distance that the wedge section 202 is positioned below the joint maker section 200.

The adjustment apparatus 206 includes a vertical joint maker adjustment apparatus 244, a vertical wedge adjustment apparatus 246, and a wedge angle adjustment apparatus 248. The vertical joint maker adjustment apparatus 244 includes a drive head 250, a threaded shaft 252, an upper support 258 and a housing 260. The drive head 250 is attached to the threaded shaft 252. The upper support 258 is attached to the top plate 212. The threaded shaft 252 freely rotates within the upper support 258 and is held in a fixed vertical position. The lower portion 256 of the threaded shaft 252 engages with internal threads in the housing 260. The exterior of the housing 260 is attached to the bottom plate 214. A socket wrench (not shown) is used to rotate the drive head 250. Rotation of the drive head 250 in a first direction causes both the joint maker section 200 and the wedge section 202 to be raised the same distance in a vertical direction. Rotation of the drive head 250 in a direction opposite to the first direction causes both the joint maker section 200 and the wedge section 202 to be lowered the same distance in a vertical direction. The vertical joint maker adjustment apparatus 244 may include a spring apparatus 262 (shown in phantom) to apply a downward force on the threaded shaft 252. Vertical adjustment is required for start up and ending a pavement mat, or paving on or off bridges. As the screed 40 is raised or lowered, the spring apparatus 262 applies a downward force to maintain the edger 50A in contact with the paving material 32.

As illustrated in FIG. 13, the vertical wedge maker adjustment apparatus 246 includes a drive head 264, a shaft 268 including an upper threaded portion 266, a lower portion 270 of the shaft 268, and a housing 272. A connector 278 may be placed between the upper threaded portion 266 and the lower threaded portion 270 of the shaft 268. The connector 278 attaches the upper threaded portion 266 with the lower threaded portion 270 of the shaft 268 and may include a breakable link such as a shear pin (not shown). The shear pin breaks if the load on the shaft 268 becomes greater than a specified load and protects the shaft 268 from damage. The drive head 264 is attached to the upper threaded portion 266. The upper threaded portion 266 passes through a hole 274 located in a support plate 279. A clip (not shown) allows the upper threaded portion 266 to rotate without moving in a direction along the longitudinal axis of the upper threaded portion 266. The support plate 279 is attached to the joint maker section 200. The lower threaded portion 270 engages with a threaded hole 280 in the housing 272. The housing 272 is attached to a wall 282 of the wedge section 202. A socket wrench (not shown) is used to rotate the drive head 264. Rotation of the drive head 264 in a first direction causes the wedge section 202 to be raised in a vertical direction relative to the joint maker section 200. Rotation of the drive head 264 in a direction opposite to the first direction lowers the wedge section 202 relative to the joint maker section 200.

As illustrated in FIG. 13, the wedge angle adjustment apparatus 248 includes a drive head 284, an upper shaft 286, a universal joint 288, a lower threaded shaft 290, and a housing 292. A connector 294 (shown in phantom) may be placed in the lower threaded shaft 290. The connector 290 may include a breakable link such as a shear pin (not shown). The shear pin breaks if the load on the lower threaded shaft 290 becomes greater than a specified load, and protects the lower threaded shaft 290 from damage. The drive head 284 is attached to the upper shaft 286. The upper shaft 286 passes through holes 298 and 300 in a support bracket 296. The support bracket 296 is attached to the wedge section 202. The universal joint 288 connects the upper shaft 286 with the lower threaded shaft 290. The universal joint 288 allows the longitudinal axis of the upper shaft 286 to be out of line with the longitudinal axis of the lower threaded shaft 290. The lower threaded shaft 290 is received in a threaded portion of the housing 292. The housing 292 is attached to the wedge section 202. A socket wrench (not shown) is used to rotate the drive head 284. Rotation of the drive head 284 in a first direction causes the outward portion 302 of the wedge section 202 to be raised relative to the hinge 66. Rotation of the drive head 284 in a direction opposite to the first direction causes the outward portion 302 of the wedge section 202 to be lowered relative to the hinge 66.

Figure 15:
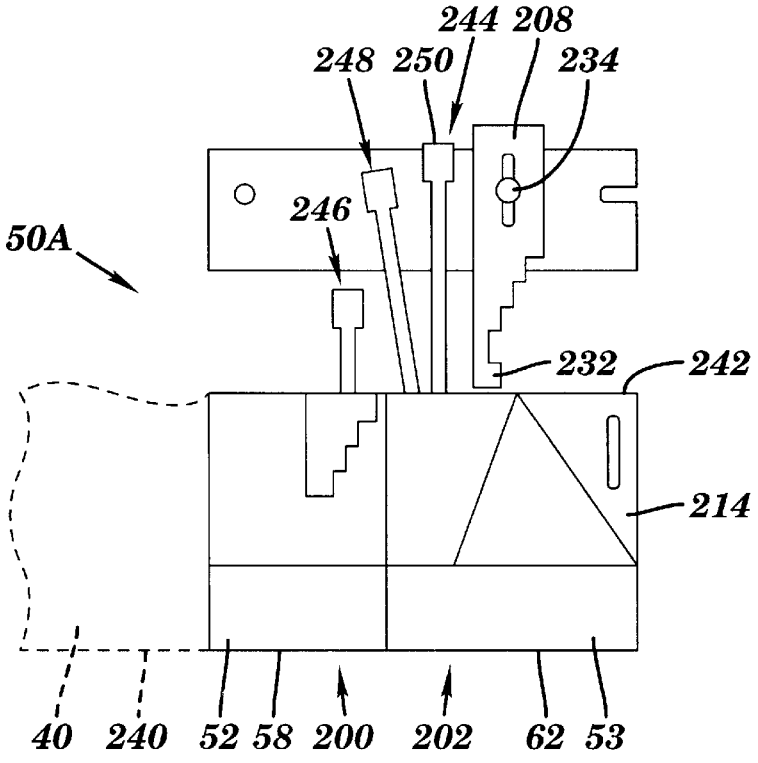
FIG. 15 illustrates a front view of the edger with the joint maker section and the wedge section adjusted to the level of a bottom edge of the screed.

FIG. 15 illustrates a front view of the edger 50A with the first compaction surface 52 and the second compaction surface 53 adjusted to the same vertical level by rotation of the drive head 250 of the vertical joint maker adjustment apparatus 244. The rearmost lower edge 62 of the second compaction surface 53 and the rearmost lower edge 58 of the first compaction surface 52 are in-line with a lower edge 240 of the screed 40 (shown in phantom). Next, the height indicator 208 is adjusted in the vertical direction until the lower surface 232 of the height indicator 208 is in-line with a top edge 242 of the bottom plate 214.

Figure 16:
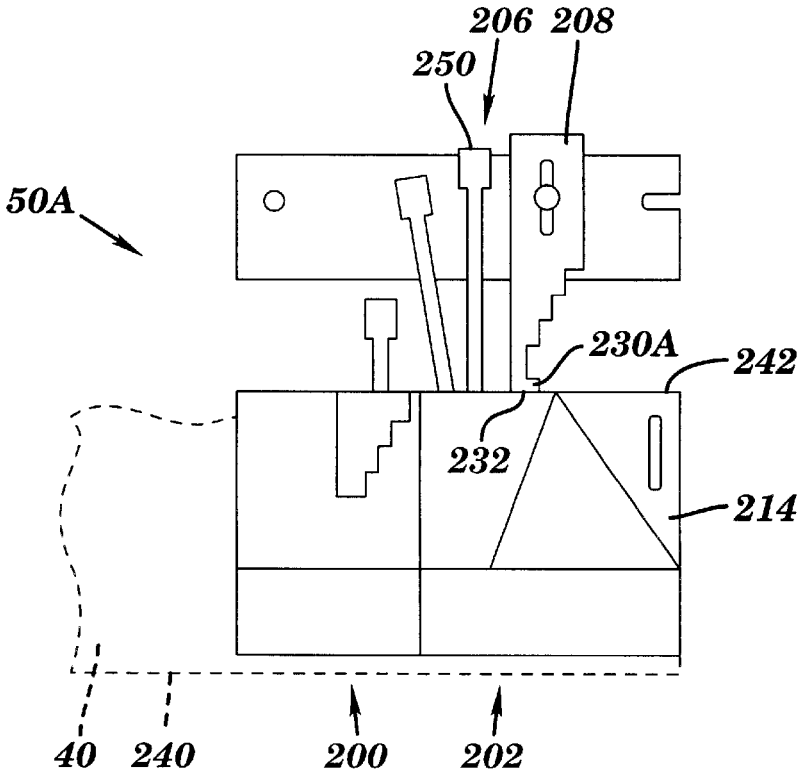
FIG. 16 illustrates a front view of the edger with the joint maker section and the wedge section adjusted a distance above the bottom edge of the screed.

FIG. 16 illustrates a front view of the edger 50A with the joint maker section 200 and the wedge section 202 adjusted one inch above the lower edge 240 of the screed 40. To obtain this position, the drive head 250 of the vertical joint maker adjustment apparatus 244 is rotated until the top edge 242 of the bottom plate is in-line with the surface 230A of the height indicator 208. The surface 230A of the height indicator 208 is one inch above the lower surface 232 of the height indicator 208.

Figure 17:
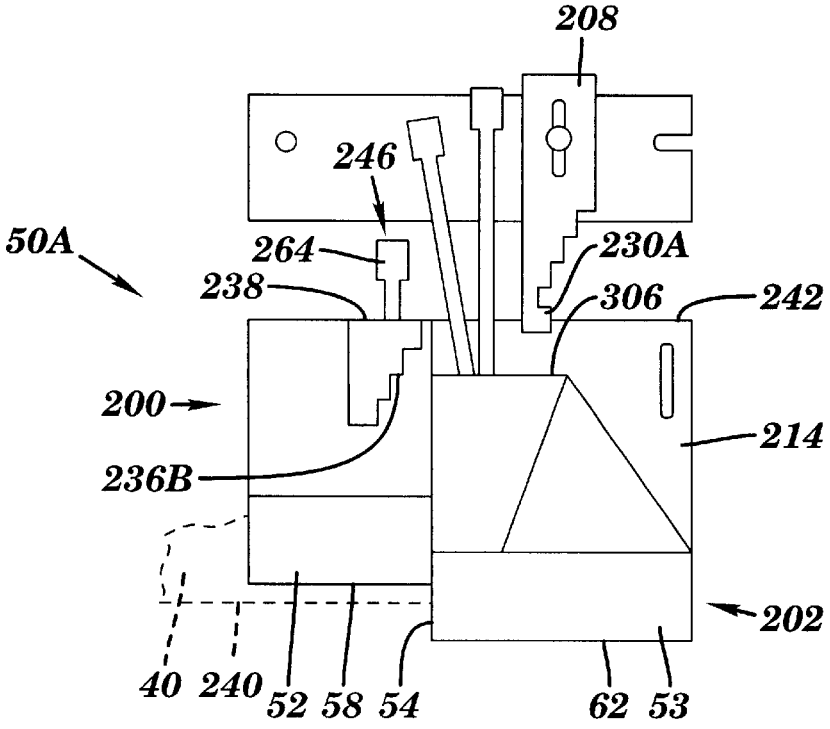
FIG. 17 illustrates a front view of the edger with the wedge section adjusted a distance below the joint maker.

FIG. 17 illustrates a front view of the edger 50A with the wedge section 202 adjusted two inches below the joint maker section 200. The drive head 264 of the vertical wedge adjustment apparatus 246 is rotated until the top edge 306 of the wedge section 202 is in-line with the surface 236B of the height indicator 208. The surface 236B is two inches below the top surface 238 of the height indicator 208. In this position, the rearmost lower edge 62 of the second compaction surface 53 is two inches below the rearmost lower edge 58 of the first compaction surface 52. This also places the rearmost lower edge 62 of the second compaction surface 53 one inch below the lower edge 240 of the rear main screed 40. The substantially vertical compaction surface 54 is in position to form the vertical face 112 (FIG. 11).

Figure 18:
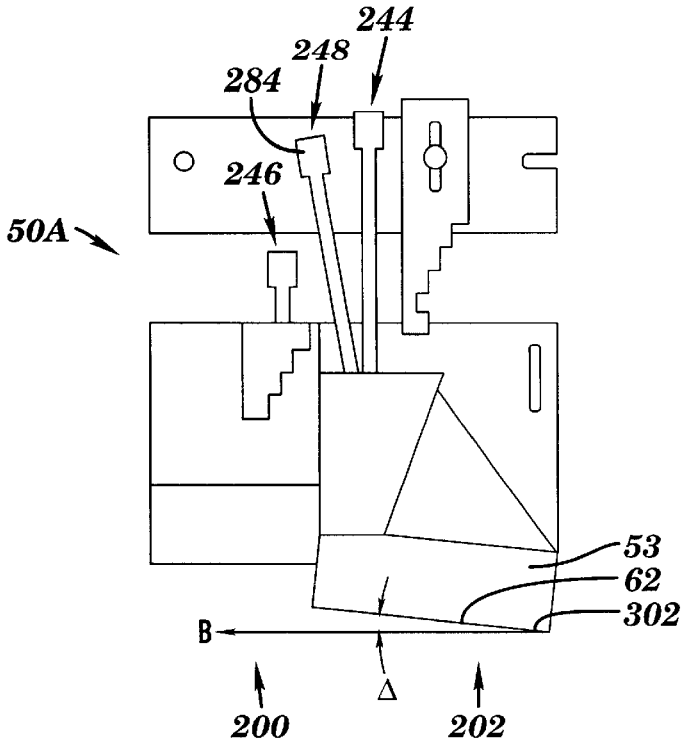
FIG. 18 illustrates a front view of the edger with the wedge section lowered into an angular position.

FIG. 18 illustrates a front view of the edger 50A with the wedge section 202 lowered into an angular position. The drive head 284 of the wedge angle adjustment apparatus 248 is rotated to lower the outward portion 302 of the wedge section 202. An angle Δ is formed between the horizontal direction B and the rearmost lower edge 62 of the second compaction surface 53. The rearmost lower edge 62 forms the tapered portion 108 of the ramp 100 as illustrated in FIG. 11. The edger 50A in the configuration illustrated in FIG. 18 is ready to form the ramp 100 (FIG. 11).

The edger 50A is adjusted to the configuration illustrated in FIG. 15 to form the joint 101 (FIG. 12). In this instance, using the wedge angle adjustment apparatus 248, the wedge section 202 is rotated so that the angle Δ is zero: Next, using the vertical wedge adjustment apparatus 246, the wedge section 202 is retracted in the vertical direction to be at the same level as the joint maker section 200. Next, the vertical joint maker adjustment apparatus 244 is used to raise the wedge section 202 and the joint maker section 200 so that the first compaction surface 52 and the second compaction surface 53 are in-line with the lower edge 240 of the screed 40. The first compaction surface 52 and the second compaction surface 53 form a contiguous joint maker surface so that when the second pavement mat 130 is laid, the edger 50A forms the joint 101 (FIG. 12).

Figure 20:
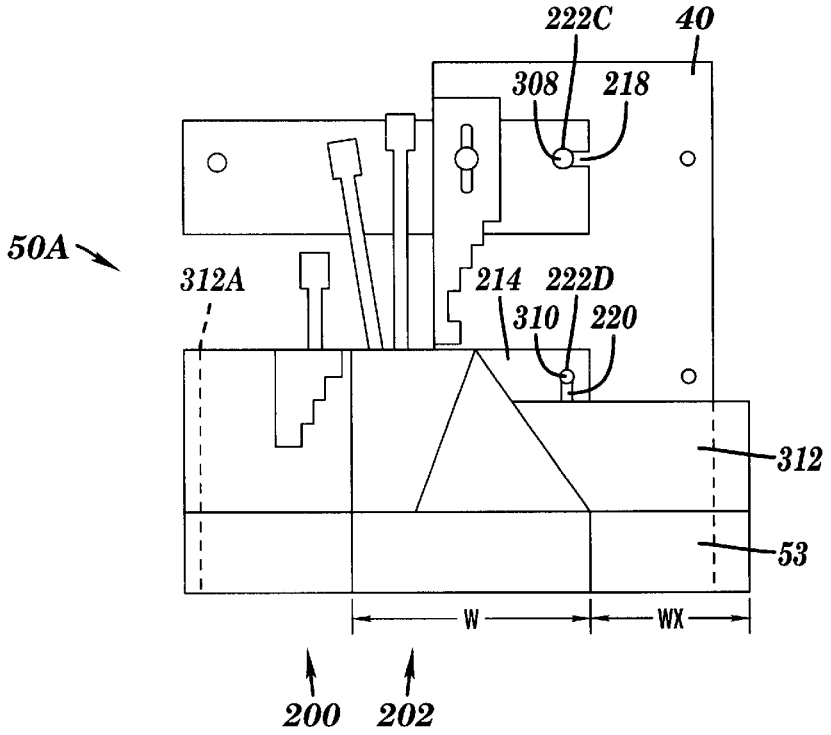
FIG. 20 illustrates a front view of the edger with a wedge extender attached to the wedge section.
Figure 21:
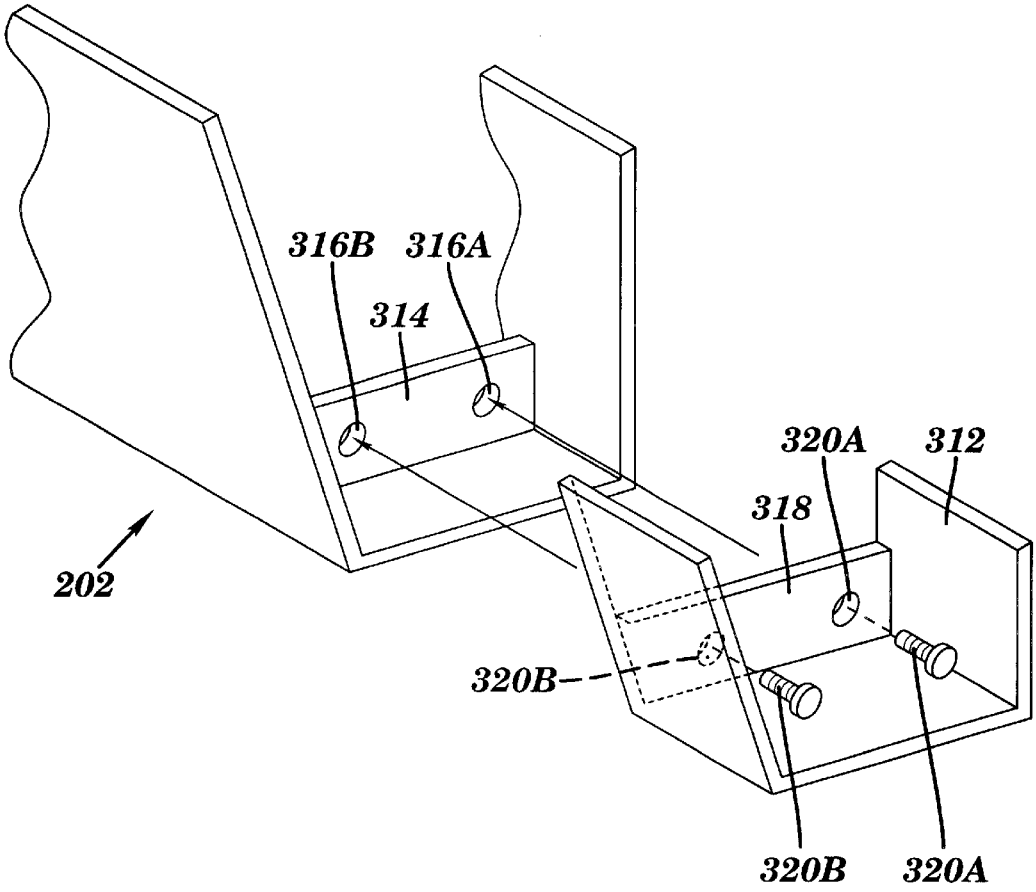
FIG. 21 illustrates an exploded view of the wedge extender attached to the wedge section.

FIG. 20 illustrates a front view of the edger 50A attached to the rear main screed 40. The edger 50A includes a wedge extender 312 removably attached to the wedge section 202. In some instances where a longer tapered portion 108 of the ramp 100 is required, the wedge extender 312 is added. FIG. 21 illustrates the wedge extender 312 being attached to the wedge section 202. The wedge section 202 includes a mounting member 314. The mounting member 314 includes threaded holes 316A and 316B. The wedge extender 312 includes a mounting plate 318. The mounting plate 318 includes holes 320A and 320B. The wedge extender 312 is joined with the wedge section 202 by a threaded bolt 320A passing through the hole 320A and fastening with the threaded hole 316A. Additionally, a threaded bolt 320B passes through the hole 320B and fastens with the threaded hole 316B. When the bolts 320A and 320B are tightened, the mounting plate 318 contacts the mounting member 314 and the wedge extender is attached to the wedge section 202. When the wedge extender is removed from the wedge section 202, the wedge extender can be stored in the joint maker section 200 as illustrated in phantom position 312A in FIG. 20.

The wedge extender 312 moves the same amount as the wedge section 202 in a vertical direction, and also is tilted the same angle Δ as the wedge section 202. As illustrated in FIGS. 19 and 20, the edger 50A is attached using a bolt 308 passing through the mounting opening 218 and into the threaded hole 222C of the screed 40. This bolt 308 is fully tightened. Also, a bolt 310 passes through the mounting opening 220 and into the threaded hole 222D of the rear main screed 40. This bolt 310 is not fully tightened allowing vertical movement of the bottom plate 214. The wedge section 202 is about 8 inches wide as denoted by "W" (FIG. 20). The wedge extender 312 adds about 4 inches in width as denoted by "WX" (FIG. 20). Thus, the wedge section 202 and the wedge extender 312 provide a total width of about 12 inches to form the tapered portion 108 of the ramp 100 (FIG. 11).

The present invention provides three types of compaction of the paving material 32. The first compaction type, denoted pre-compaction, is provided by the first compaction surface 52 and the second compaction surface 53 of the edger 50A (FIG. 13). The first compaction surface 52 and the second compaction surface 53 compact the paving material 32 in a substantially vertical direction. The second compaction type, called horizontal shear compaction, is provided by the vertical compaction surface 54 being at the horizontal lateral angle β relative to the direction of travel (FIG. 14). The vertical compaction surface 54 receives and compacts paving material 32 horizontally to form the substantially vertical face 112. This horizontal shear compaction results in the highly compacted area 118 underneath the substantially vertical face 112 (FIG. 11). The third compaction type, called primary compaction, is provided by the screed 40 pressing downward on the paving material 32. The combination of the three compaction types forms a paving joint with compaction between 85% and 93% of complete compaction.

The foregoing description of the present invention has been presented for purposes of illustration and description. It is not intended to be exhaustive or to limit the invention to the precise form disclosed, and many modifications and variations are possible in light of the above teaching. For example, it should be recognized that either edger 50 or 50A is capable of providing pre-compaction or post-compaction of pavement depending on its position relative to the screed. In other words, although either edger 50 or 50A has been illustrated as being mounted in front of screed 40 or screed extender 48, it is also within the scope of the invention that either edger 50 or 50A follow screed 40 or screed extender 48 to provide post-compaction. In this instance, the forming steps for ramp 100 are preceded by the leveling of first pavement mat 102 by screed 40. Such modifications and variations that may be apparent to a person skilled in the art are intended to be included within the scope of this invention as defined by the accompanying claims.

I claim:

1. A paving machine comprising:

a system for providing precompaction of a paving material;

a system for providing horizontal shear compaction of the paving material; and a system for providing primary compaction of the paving material.

2. The paving machine of claim 1, wherein the system for providing precompaction includes a first compaction surface to compact a top surface of the paving material, and a second compaction surface to compact a tapered portion of the paving material.

3. The paving machine of claim 1, wherein the system for providing the horizontal shear compaction includes a substantially vertical third compaction surface horizontally angled relative to a forward direction of movement of the paving machine to gather and compact the paving material in a horizontal direction.

4. The paving machine of claim 1, wherein the system for providing primary compaction includes a screed for further compacting the paving material.

5. The paving machine of claim 1, wherein the system for providing precompaction of the paving material includes a screed.

6. The paving machine of claim 1, wherein the system for providing primary compaction includes a first compaction surface to compact a top surface of the paving material, and a second compaction surface to compact a tapered portion of the paving material.

7. An edger comprising:

a first compaction surface;

a second compaction surface;

a substantially vertical third compaction surface between the first compaction surface and the second compaction surface;

wherein the vertical third compaction surface is set at an angle in a horizontal lateral direction relative to a forward direction of movement of the pavement edge maker to receive and compact material in a horizontal direction;

a wedge extender removably attached to the second compaction surface; and a mounting assembly for mounting the edger on a screed.

8. The edger of claim 7, wherein each of the compaction surfaces is set at an upward angle relative to a forward direction of travel of the edger.

9. The edger of claim 8, wherein the upward angle is less than 45°.

10. The edger of claim 7, wherein the third compaction surface is set at an angle relative to a forward direction of movement of the edger whereby the third compaction surface gathers and compacts a paving material in a horizontal direction.

11. The edger of claim 7, wherein the second compaction surface is angled relative to the third compaction surface.

12. The edger of claim 7, wherein a hinge connection pivotally connects the second and third compaction surfaces.

13. The edger of claim 12, wherein the hinge connection is positioned at an angle to prevent the second compaction surface from contacting the screed.

14. The edger of claim 12, further including an angle adjustment apparatus for angling the second compaction surface relative to the third compaction surface.

15. The edger of claim 14, further including a breakable link to protect the angle adjustment apparatus from overload damage.

16. The edger of claim 7, further including a vertical adjustment apparatus for vertically moving the second and third compaction surfaces relative to the first compaction surface.

17. The edger of claim 16, further including a location indicator for measuring a distance between the first compaction surface and the second and third compaction surfaces.

18. The edger of claim 16, further including a breakable link to protect the vertical adjustment apparatus from damage due to overload.

19. The edger of claim 7, further including an adjustment apparatus for simultaneously moving the first compaction surface, the second compaction surface, and the third compaction surface in a vertical direction.

20. The edger of claim 7, further including a height indicator for determining a distance that the first, second, and third compaction surfaces are above or below a bottom edge of the screed.

21. The edger of claim 7, further including an apparatus to bias the first, second, and third compaction surfaces in a downward direction.

22. The edger of claim 7, further including a flexible boot attached to an open end of the second compaction surface for preventing a paving material from leaking out of the open end.

23. A method of paving comprising:

applying a precompaction to a paving material;

applying a horizontal shear compaction to the paving material; and applying a primary compaction to the paving material.

24. The method of claim 23, wherein the step of applying precompaction includes applying a first compaction to a top surface of the paving material, and applying a second compaction to a tapered portion of the paving material.

25. The method of claim 23, wherein the step of applying horizontal shear compaction includes gathering and compacting the paving material in a horizontal direction forming a substantially vertical surface.

26. The method of claim 23, wherein the step of applying primary compaction includes a screed for further compacting the paving material.

* * * * *